US008112841B2

(12) United States Patent
Garcia et al.

(10) Patent No.: US 8,112,841 B2
(45) Date of Patent: Feb. 14, 2012

(54) ULTRAVIOLET VACUUM CLEANER WITH SAFETY MECHANISM

(75) Inventors: Ken V. Garcia, Charlotte, NC (US); Carrie P. Garcia, Charlotte, NC (US)

(73) Assignee: Oreck Holdings LLC, Nashville, TN (US)

( * ) Notice: Subject to any disclaimer, the term of this patent is extended or adjusted under 35 U.S.C. 154(b) by 971 days.

(21) Appl. No.: 12/106,203

(22) Filed: Apr. 18, 2008

(65) Prior Publication Data

US 2008/0256741 A1 Oct. 23, 2008

Related U.S. Application Data

(63) Continuation-in-part of application No. 11/360,045, filed on Feb. 22, 2006, now Pat. No. 7,444,711, and a continuation-in-part of application No. 11/360,189, filed on Feb. 22, 2006.

(51) Int. Cl.
*A47L 9/28* (2006.01)

(52) U.S. Cl. ..... 15/319; 15/339; 15/351; 15/246.3; 15/410; 15/DIG. 10

(58) Field of Classification Search ..... 15/319, 15/339, 324, 351, 246.3, 410, DIG. 10; 422/24, 422/121; *A47L 9/28*
See application file for complete search history.

(56) References Cited

U.S. PATENT DOCUMENTS

| | | | |
|---|---|---|---|
| 2,590,152 | A | 3/1952 | Buckey |
| 3,798,704 | A | 3/1974 | Kilstrom et al. |
| 4,355,436 | A | 10/1982 | Hertzberg |
| 4,498,214 | A | 2/1985 | Oxel |
| 4,786,812 | A | 11/1988 | Humphreys |
| 4,907,316 | A | 3/1990 | Kurz |
| 5,014,387 | A | 5/1991 | Hays |
| 5,045,118 | A | 9/1991 | Mason et al. |
| 5,233,723 | A | 8/1993 | Hung |
| 5,467,501 | A | 11/1995 | Sepke |
| 5,968,455 | A | 10/1999 | Brickley |
| 6,094,767 | A | 8/2000 | Iimura |
| 6,239,442 | B1 | 5/2001 | Iimura |
| 6,514,356 | B2 | 2/2003 | Vystreil et al. |
| 6,572,711 | B2 | 6/2003 | Sclafani et al. |
| 6,760,952 | B1 | 7/2004 | Stegens |
| 6,776,824 | B2 | 8/2004 | Wen |
| 6,968,587 | B2 | 11/2005 | Grey |
| 7,013,521 | B2 | 3/2006 | Grey |
| 2001/0004719 | A1 | 6/2001 | Sommer |

(Continued)

FOREIGN PATENT DOCUMENTS

| | | | |
|---|---|---|---|
| DE | 004138162 | C1 | 9/1992 |

(Continued)

*Primary Examiner* — David Redding
(74) *Attorney, Agent, or Firm* — Winston & Strawn LLP

(57) ABSTRACT

A combination vacuum cleaner and ultraviolet disinfecting device is presented having a vacuum for cleaning a cleaning medium, such as a carpet, and a UV light source for radiation of the cleaning medium to eradicate the medium of infestation agents such as molds, viruses, bacteria and dust mites. The device provides a multiple of safety switches to prevent power supply to the UV light source under certain conditions. Safety switches are provided requiring a constant activation of a switch by the user on the device handle, activation of contact switches indicating the device is in contact with the cleaning medium, activation of a switch indicating the device is in an in-use position, and a tilt sensor to prevent power supply to the UV light if the device, or a portion thereof, is tilted beyond a preselected degree.

18 Claims, 16 Drawing Sheets

U.S. PATENT DOCUMENTS

| | | | |
|---|---|---|---|
| 2004/0077407 | A1 | 4/2004 | Jandel |
| 2004/0107528 | A1 | 6/2004 | LeClear et al. |
| 2004/0111826 | A1 | 6/2004 | Grey |
| 2004/0211444 | A1 | 10/2004 | Taylor et al. |
| 2004/0221406 | A1 | 11/2004 | Grey |
| 2004/0244138 | A1 | 12/2004 | Taylor et al. |
| 2004/0255411 | A1 | 12/2004 | Grey |
| 2005/0000543 | A1 | 1/2005 | Taylor et al. |
| 2005/0010331 | A1 | 1/2005 | Taylor et al. |
| 2005/0022844 | A1 | 2/2005 | Field et al. |
| 2006/0020369 | A1 | 1/2006 | Taylor et al. |
| 2006/0216193 | A1 | 9/2006 | Johnson et al. |
| 2006/0236496 | A1 | 10/2006 | Oh et al. |
| 2007/0192986 | A1 | 8/2007 | Garcia et al. |
| 2007/0192987 | A1 | 8/2007 | Garcia et al. |
| 2007/0194255 | A1 | 8/2007 | Garcia et al. |
| 2007/0209144 | A1 | 9/2007 | Fester et al. |
| 2007/0209147 | A1 | 9/2007 | Krebs |

FOREIGN PATENT DOCUMENTS

| | | | |
|---|---|---|---|
| DE | 004139199 | A1 | 6/1993 |
| JP | 2004283545 | A | 10/2004 |

ULTRAVIOLET VACUUM CLEANER WITH SAFETY MECHANISM

CROSS-REFERENCE TO RELATED APPLICATIONS

This application claims priority of and is a continuation-in-part of U.S. Ser. No. 11/360,045 filed Feb. 22, 2006, now U.S. Pat No. 7,444,711 and also co-pending U.S. Ser. No. 11/360,189 filed Feb. 22, 2006, which are incorporated by reference for all purposes.

STATEMENT REGARDING FEDERALLY SPONSORED RESEARCH OR DEVELOPMENT

None

REFERENCE TO MICROFICHE APPENDIX

Not applicable

FIELD OF THE INVENTION

The invention generally relates to using ultraviolet radiation to disinfect various cleaning media. The invention more particularly relates to a combination vacuum cleaner and ultraviolet sanitizer, for disinfecting infestation agents within various cleaning media by using ultraviolet radiation, and safety mechanisms for preventing injury by the user.

BACKGROUND OF THE INVENTION

Many homes and businesses suffer from infestations of allergens and other undesirable organic and inorganic substances, such as molds, viruses, bacteria, and dust mites. Floor coverings such as carpeting in homes and hotels, for example, can contain a high concentration of organic or inorganic substances, which create a potentially unhealthy or harmful environmental condition. A common indoor allergen in carpeting and mattresses that can trigger allergy symptoms in humans is the dust mite, a microscopic insect related to spiders. It has been claimed that allergies developed in the early years of a child's life due to exposure to allergens can result in life-long allergic responses or more serious medical conditions such as asthma. Exposure to mold spores, for example, has been linked to certain types of respiratory illnesses. Long-term exposure to mold may cause asthma or other respiratory problems, even in individuals who are not naturally sensitive or allergic to mold.

Conventional cleaning methods do not effectively reduce populations of infestation agents present within carpeting. Standard vacuum cleaners do not sanitize or disinfect carpeting, and vacuuming alone usually removes only a fraction of allergens from carpeting. Typically, steam cleaning is cumbersome, expensive, and may involve the use of chemicals. Also, steam cleaning can leave a carpet and its carpet pad in a wet condition that can support the undesirable growth of molds, mildew, bacteria, or dust mites in or beneath the carpet. As another alternative, chemical powders or dry carpet cleaning powders comprised primarily of chemical pesticides and insecticides may be used to clean carpeting. The potential health and safety hazards associated with such chemical powders, however, often outweigh any benefits that might be obtained by using them.

Many experts have suggested that the only solution to dealing with infestation agents in carpeting is to remove existing carpeting altogether and to refrain from using carpeting as a floor covering. However, for many individuals who find carpeting desirable, and for many applications where carpeting is an optimum choice for a floor covering, this is not an acceptable solution. As a result of the inadequacy of conventional carpet cleaning methods, however, carpeting in homes and commercial establishments can become an ideal environment in which dust mites, germs, bacteria, viruses, molds and other pathogens or microorganisms can live, grow, and multiply.

In addition, mattresses and other like articles are often afflicted by infestation agents. By the nature of how a mattress is used for rest or sleep, it is frequently in close contact with humans or animals that may shed dead skin, for example, or discard other organic substances that are retained in the mattress. Insects such as dust mites can thrive on this organic matter and quickly develop into a significant population within the mattress. As described above for carpeting, conventional cleaning methods applied to a mattress cannot both safely and effectively reduce populations of infestation agents present within the mattress.

It has been discovered that ultraviolet ("UV") light, particularly in the "C" spectrum ("UVC"), can deactivate the DNA of bacteria, viruses, germs, molds, and other pathogens and microorganisms, thus destroying their ability to reproduce and multiply. UVC light has been used effectively in various applications to disinfect and sanitize hospital rooms, medical clinics, food production facilities, and drinking water. However, existing products and processes have been unable to effectively and safely leverage the benefits of UV light to sanitize infestation agents in cleaning media such as carpeting and mattresses.

In view of the problems described above, safe and effective disinfecting devices are needed to address the deficiencies of conventional processes for sanitizing cleaning media such as carpeting and mattresses.

BRIEF DESCRIPTION OF THE FIGURES

The utility of the embodiments of the invention will be readily appreciated and understood from consideration of the following description of the embodiments of the invention when viewed in connection with the accompanying drawings.

DETAILED DESCRIPTION OF PREFERRED EMBODIMENTS

The invention provides embodiments of cleaning and disinfecting devices, and features thereof, which offer various benefits: the devices maximize the disinfection capability of ultraviolet ("UV") light by providing mechanisms for enhanced penetration of the UV light into a cleaning medium. The invention provides safety devices to protect the user from harmful exposure to UV light.

Incorporated herein by reference for all purposes are the co-pending U.S. applications: Ser. Nos. 11/360,045, 11/360,189, 11/360,046, and 11/360,044, all filed on Feb. 22, 2006, to Garcia, et al.

As applied herein, the term "cleaning medium" includes any area, region, substrate, surface, or other medium that can be acted upon by UV light. Examples of cleaning media include, without limitation, carpets, mattresses, furniture, drapery, or other surfaces or media (e.g., hardwood, linoleum, and ceramic tile). The cleaning medium can be horizontal, as in a typical floor or mattress top surface, or vertical or at any other angle, such as with drapery and furniture surfaces.

The term "infestation agent" may include any organism, microorganism, contagion, pathogen, germ, insect, and/or any other organic or inorganic substance which can be affected by application of ultraviolet radiation, or which can be present on or within a cleaning medium. Examples of infestation agents include, without limitation, viruses, bacteria, dust mites, molds, roaches, fleas, bed bugs, spiders, and other insects.

Figure 1:
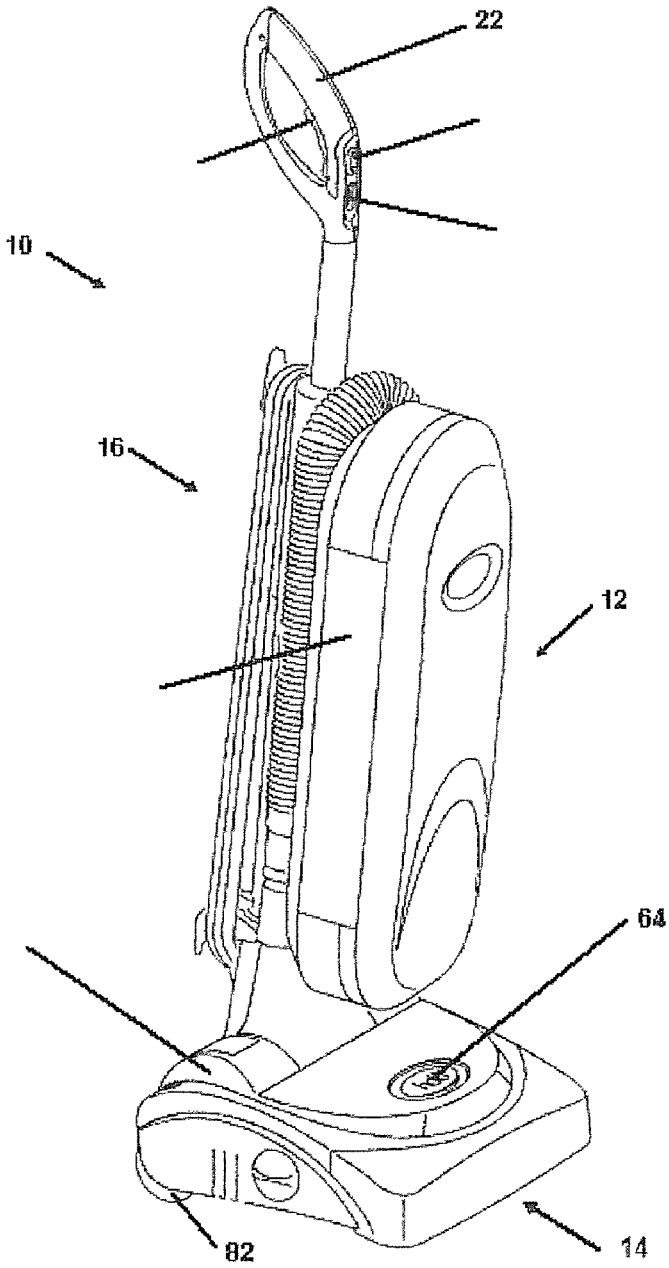
FIG. 1 is an orthogonal view of an ultraviolet vacuum device according to one embodiment of the invention.

FIG. 1 generally shows an ultraviolet vacuum device 10 having a vacuum cleaner assembly and an ultraviolet disinfecting assembly. The device 10 has an upper housing 12 and a lower housing 14 which, in use, contacts the cleaning medium, such as a floor or other generally horizontal surface to be cleaned and disinfected. The upper housing 12 is rotatable or otherwise movable from a storage position 16, as shown, to an in-use position 18 wherein the upper housing is rotated back for ease of use. The upper housing 12 includes a dust bag, an alternate hose extension, and a handle assembly 20. The lower housing 14 can also include impeller cover 44, shown in two parts, and the impeller housing 43, described herein. The Figures and description are of preferred embodiments and are not intended to limit the claimed invention.

Figure 2:
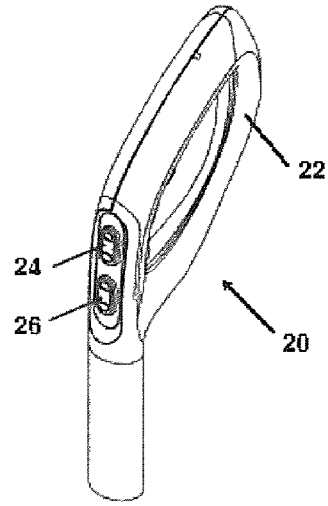
FIG. 2 is an orthogonal view of an exemplary handle assembly of the device.
Figure 3:
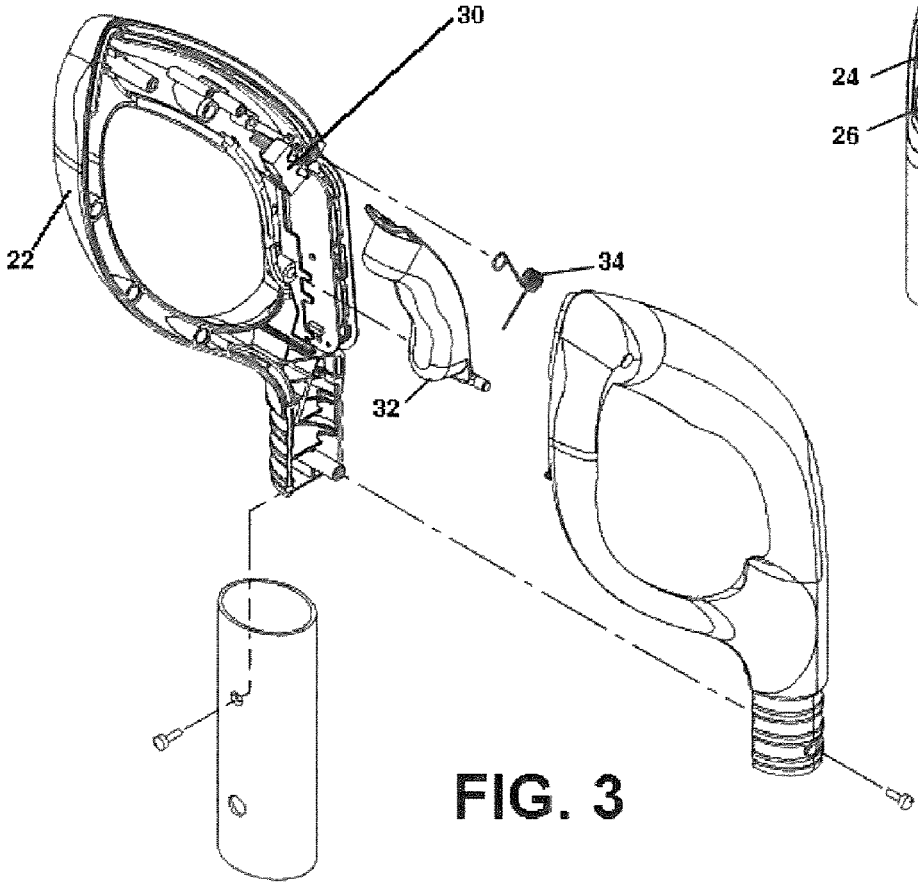
FIG. 3 is an exploded view of the handle assembly.

FIG. 2 is an orthogonal view of an exemplary handle assembly 20 of the device 10. FIG. 3 is an exploded view of the handle assembly 20. The handle assembly 20 includes a handle 22. At least one power switch 24, 26 are mounted on the handle assembly 20. The power switches 24, 26 can be mounted anywhere on the device 10. The power switches 24 and 26 are each movable between an on and off position and control power to the UV light source, the vacuum motor, and/or the brush bar motor. In one embodiment, the power switch 24 controls power supply to the UV light and vacuum motor while the power switch 26 controls power supply to the brush bar motor. Other arrangements may be employed.

FIG. 3 is an exploded view of the handle assembly of FIG. 2. The handle assembly 20 includes a safety switch assembly 28. The safety switch assembly 28 includes an electrical switch 32, which is activated by a depression-pad or trigger 32 which is contacted by the user. In use, the trigger 30 must be depressed by the user for the UV light to be supplied with power; that is, for the UV light to be "on," the trigger must be depressed. The trigger 32 is biased by biasing spring 34 such that the switch is in an "off" position unless the trigger is activated. In such a manner, the device is provided with a deadman's safety switch. The UV light is off unless the user maintains pressure on the trigger switch. Should the user cease to actively depress the trigger, the UV light shuts off. The illustrated trigger switch is one type of deadman's switch which may be employed. The switch 30 is connected to the UV light through appropriate electrical circuitry.

As with all of the safety switches employed herein, the switch may be a normally closed or normally open switch. Further, the switches may be signal switches, or low-voltage switches, which open or close a signal circuit to provide a signal to a microprocessor or similar device and indicates that power may be provided or denied to the UV light. Alternately, the switches may be "live" current switches, or high-voltage switches, which are placed directly in the circuitry providing power to the UV light. In such a manner, the high-voltage switch directly operates to open or close the power circuit. The switches herein are exemplary only. For example, many of the switches, including the handle safety switch, are shown as contact switches. Alternate switch types may be employed where practicable, such as optical, proximity, electromagnetic, pressure, position switches, piezoelectric, force, vibration, acceleration, etc. The function of the switch (the action or condition that activates the switch) is of greater importance than the switch type. In the case of the handle assembly switch, the goal is to signal a microprocessor to prevent, or directly prevent, power supply to the UV light unless the handle trigger is constantly activated by the user. A contact switch is illustrated, but another switch type, such as a pressure or temperature switch, could be used.

Figure 4:
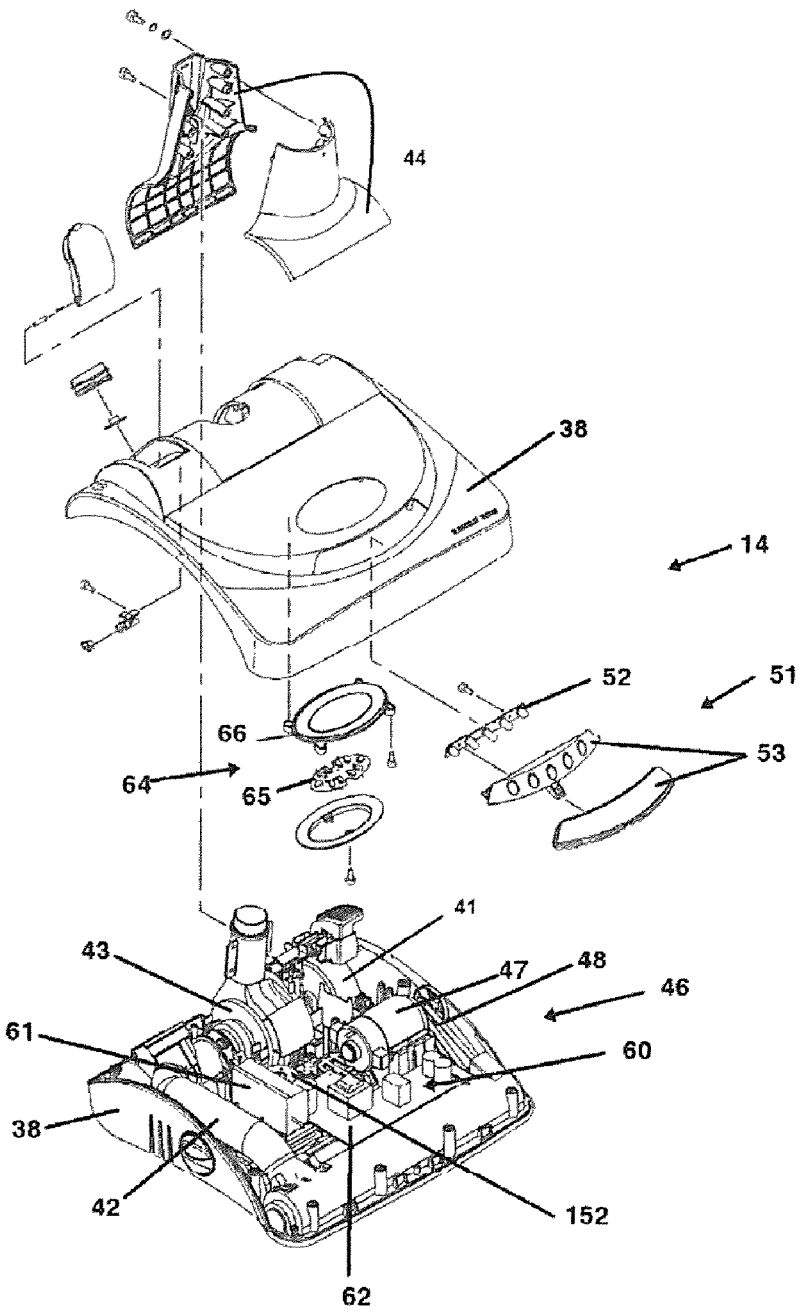
FIGS. 4 and 5 are exploded views of a preferred embodiment of the lower housing of the device.
Figure 5:
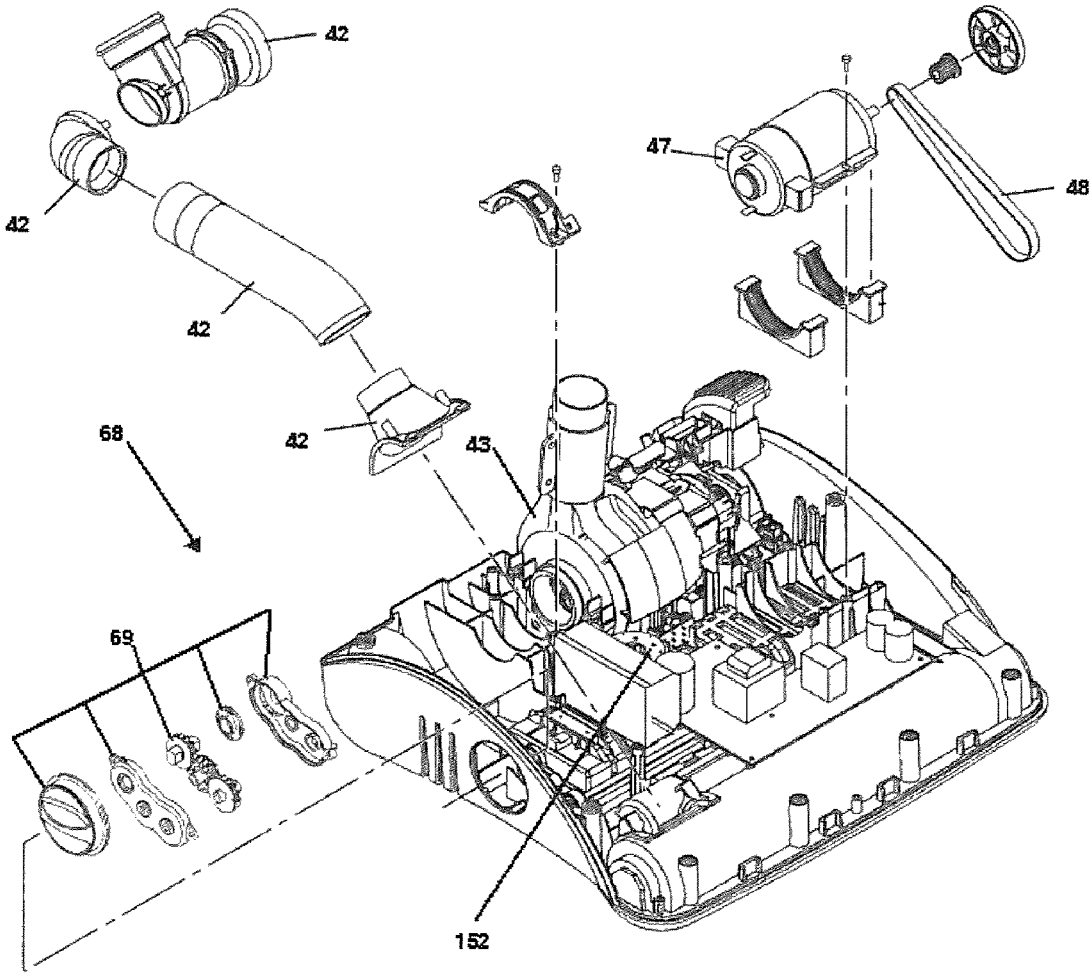

FIGS. 4 and 5 are exploded views of a preferred embodiment of the lower housing 14 of the device 10. The lower housing 14 is encased by a housing cover 38, here shown in two portions. The lower housing 14 can house the vacuum assembly 40, including impeller motor 41, vacuum ducting 42, and other parts of the vacuum assembly. The lower housing 14 can also house a beater bar or rotary brush assembly 46, including the brush motor 47, brush strap 48, brush housing 49 and brush 50. The lower housing 14 also includes the UV light assembly 110, described herein and in related applications. The lower housing 14 is shown as including a pathway light assembly 51, with a light source 52 and cover 53.

In a preferred embodiment, the lower housing 14 also houses most of the electronic circuitry 60 of the device, including the ballast 61, an electronic board 62, wiring to connect the various electronic components, and a microprocessor 63 for controlling aspects of the circuitry. The lower housing also includes an AC power input such that the device may be powered from an electrical outlet such as in a home. The device includes transformers, rectifiers and other electric elements which will not be described in detail.

In a preferred embodiment, the lower housing 14 includes an indicator assembly 64. The indicator assembly 64 provides a visible indication to the user, such as a light, as to whether the UV light is on or off. Here, the indicator assembly includes lights 65 and cover 66. The indicator assembly may alternately be placed in the upper housing.

The lower housing may include a height adjustment assembly 68 for adjusting the height of the bottom of the lower housing above the cleaning medium. Adjustment knob assembly 69 is seen in FIG. 5 in an exploded view. The height adjustment wheel assembly 70 is seen in FIG. 6.

Figure 6:
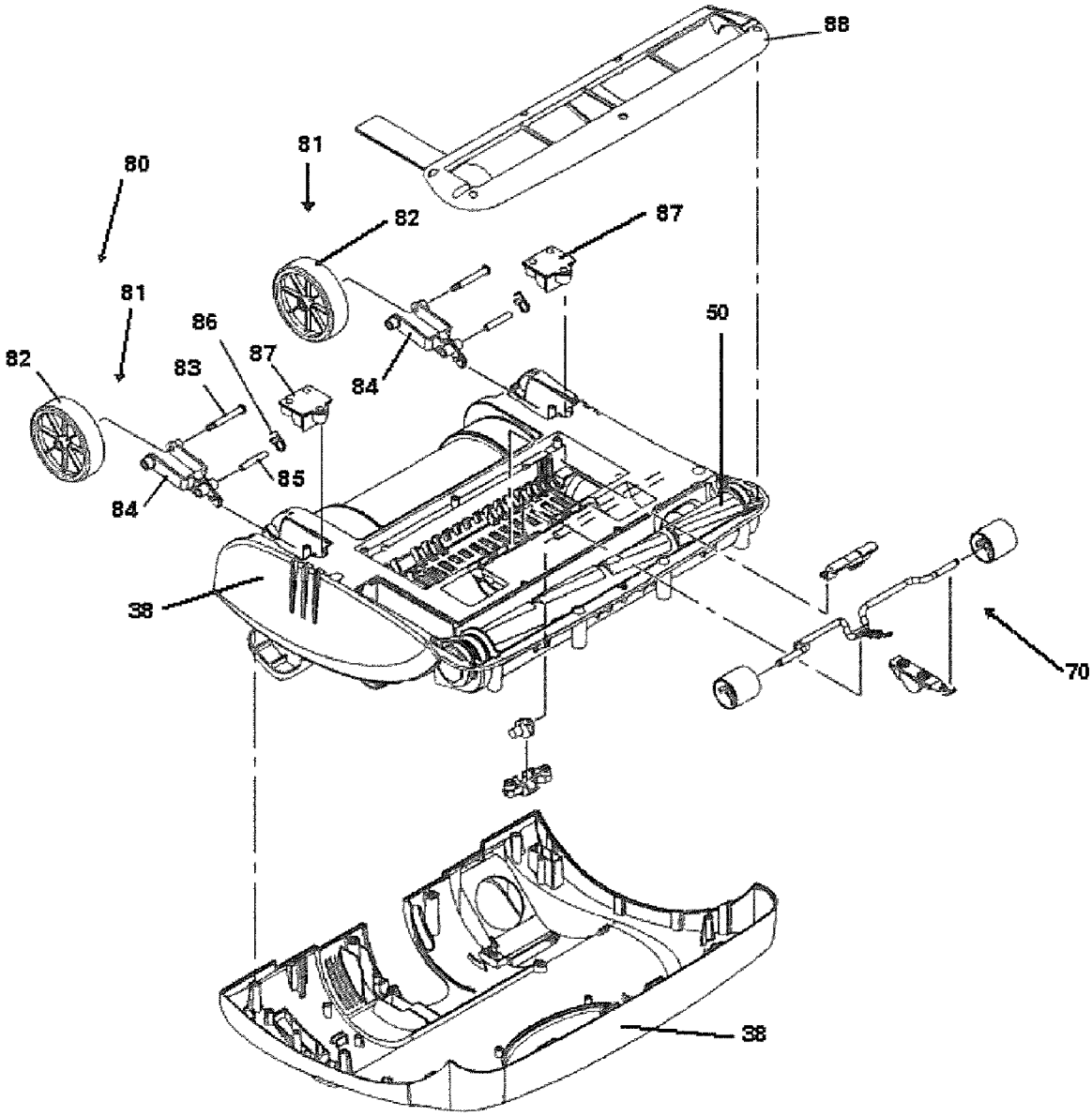
FIG. 6 is a exploded view of the lower housing from below.

FIG. 6 is an exploded view of the lower housing from below. The lower housing 14 includes wheel assembly 80 and medium contact safety switch assembly 100 which, in a preferred embodiment, act in concert. Wheel assembly 80 includes two wheel units 81 which each include a wheel 82, wheel shaft 83, swing arm 84, wheel lock shaft 85, biasing spring 86 and wheel hold cover 87. Also seen in FIG. 6 is lower housing bottom plate 88.

Figure 7:
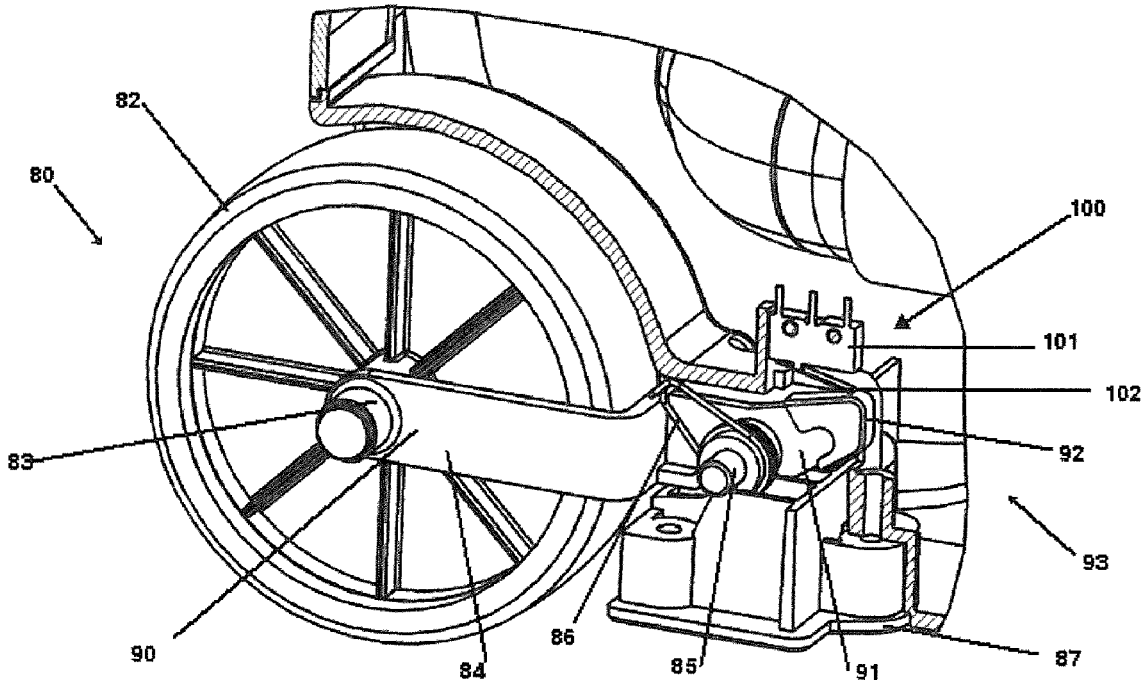
FIGS. 7 and 8 are cross-sectional, partial views of the lower housing showing the wheel assembly and medium contact safety switch assembly in detail.
Figure 8:
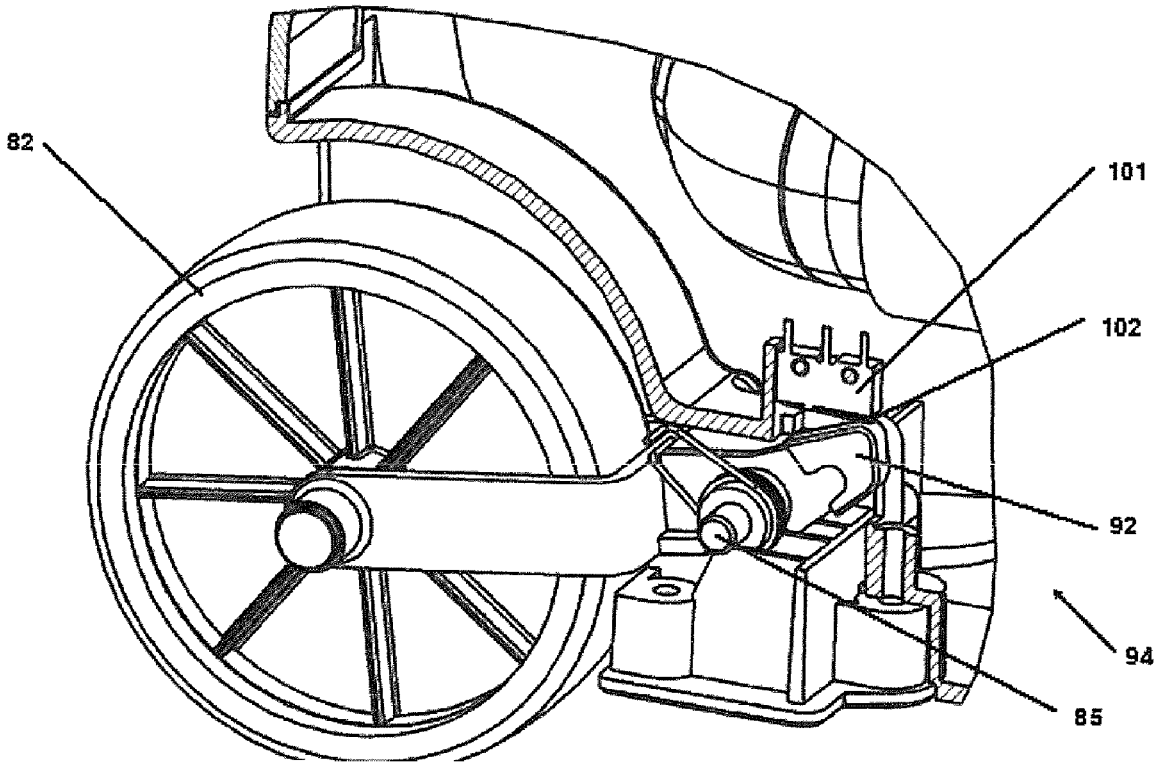

FIGS. 7 and 8 are cross-sectional, partial views of the lower housing showing the wheel assembly 80 and medium contact safety switch assembly 100 in detail. FIG. 7 shows the wheel assembly in an "up" position 93; FIG. 8 shows the wheel assembly in a "down" position 94. The wheel 82 is mounted for rotation about shaft 83 on the wheel-end 90 of swing arm 84. The wheel-end 90 of the swing arm 84 is shaped like a horseshoe in a preferred embodiment to accommodate a secure mounting of the wheel. The swing arm 84 pivots about the lock shaft 85. As the wheel-end 90 of the swing arm 84 moves upwards, the free-end 91 of the swing arm 84 moves downward. The free-end of the swing arm can include a non-metallic cover 92. The spring 86 biases the wheel assembly into the "down" position 94.

In use, the weight of the device, as the wheels 82 sit on the cleaning medium, force the wheels upward, and, consequently, the free-end 91 of the swing arm 84 downward. In the wheels "up" position 93, as shown, the free-end of the swing arm does not activate the contact switch assembly 100, as seen in FIG. 7. If the user lifts the lower housing away from the cleaning medium a predetermined distance, the wheels 82 drop downward and the free-end 91 of the swing arm moves into contact with, and activates, the medium contact safety switch assembly 100, as seen in FIG. 8.

The medium contact safety switch assembly 100 includes switch 101 and lever arm 102. When lever arm 102 is depressed by the swing arm 84, as seen in FIG. 8, the switch is activated. The medium contact switch is exemplary. The "medium contact switch" is defined as any safety switch operable to sense or detect whether the lower housing is proximate to or in contact with the cleaning medium. The medium contact switch can be a contact switch which is activated by movement of some part of the lower housing, such as the wheel assembly, as shown. Alternately, the medium contact switch can be directly mounted to the bottom of the lower housing with an activator button directly contacting the cleaning medium, as shown in related patent applications. The medium contact switch can alternately be a proximity, pressure or other type of switch, and can employ an optical, piezoelectric or other type of sensor.

In a preferred embodiment, the device employs medium contact switch assemblies 100 in conjunction with both wheel assemblies 80. If either of the medium contact switches 101 indicate that the lower housing is more than a prescribed distance from the cleaning medium, power is cut to the UV light assembly. As described above, the switch assembly 100 can be a normally open or closed switch, a signal or live switch, etc.

Figure 9:
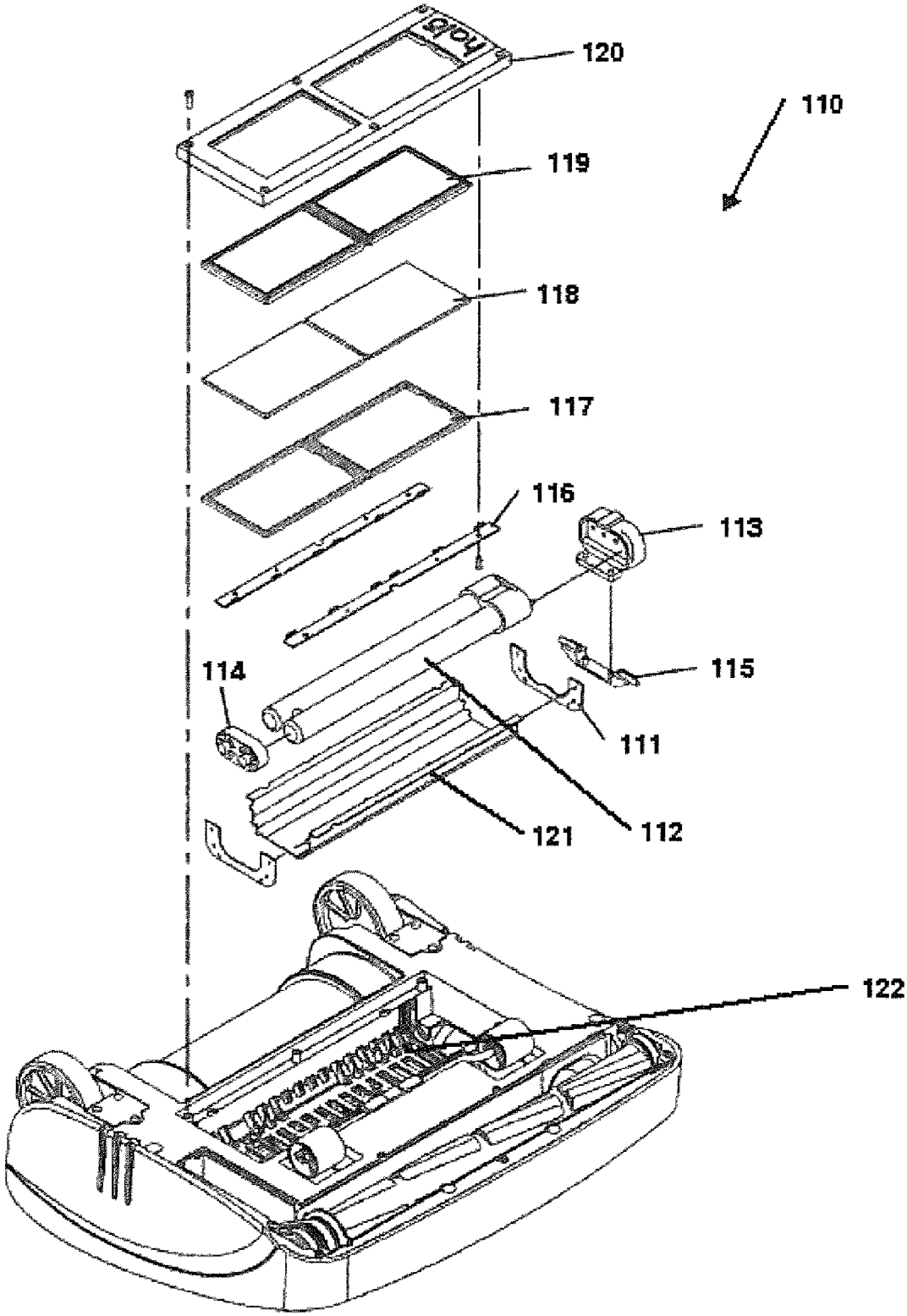
FIG. 9 is an exploded view of the UV light assembly of the lower housing.

FIG. 9 is an exploded view of the UV light assembly 110 of the lower housing 14. At least one UV light source 112, such as a UV light bulb, is positioned to radiate UV light onto the cleaning medium when the device is in use. An embodiment of the UV light assembly is described in detail in related patent applications. UV bulbs 112 are removably mounted in sockets 113 with support provided by a rubber seating 114. Socket 113 is mounted to the lower housing via socket bracket 115. Side covers 111 are provided at the ends of the bulbs. Aluminum frame plates 116, a rubber frame 117, lens 118, lens frame 119 and cover frame 120 are provided as shown. The UV light assembly radiates UV light through lens 118 onto the cleaning medium. The UV light assembly preferably includes a reflector 121. The bulb assembly is mounted in the lower housing 14 in a recess 122. A cooling system for the bulb assembly is described in the related patent applications.

Figure 10:
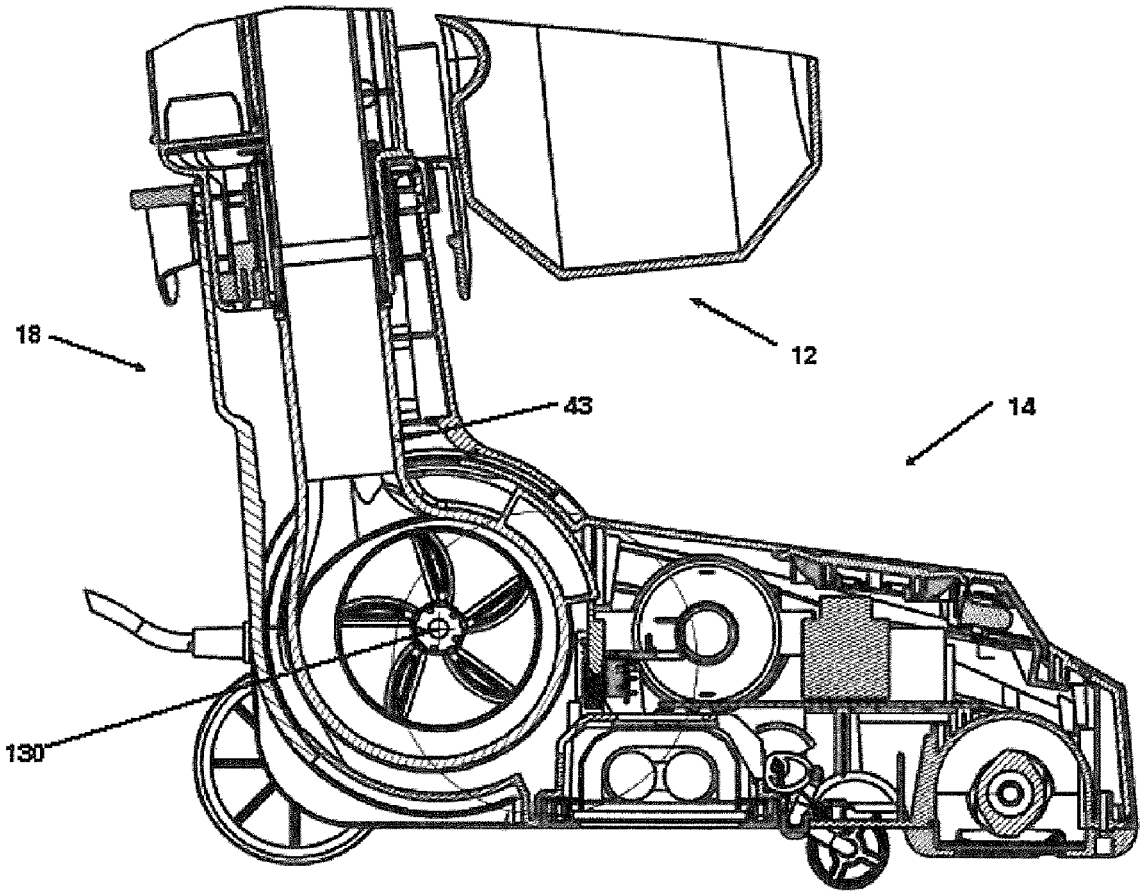
FIG. 10 is a partial cross-sectional elevation view of the device.
Figure 11:
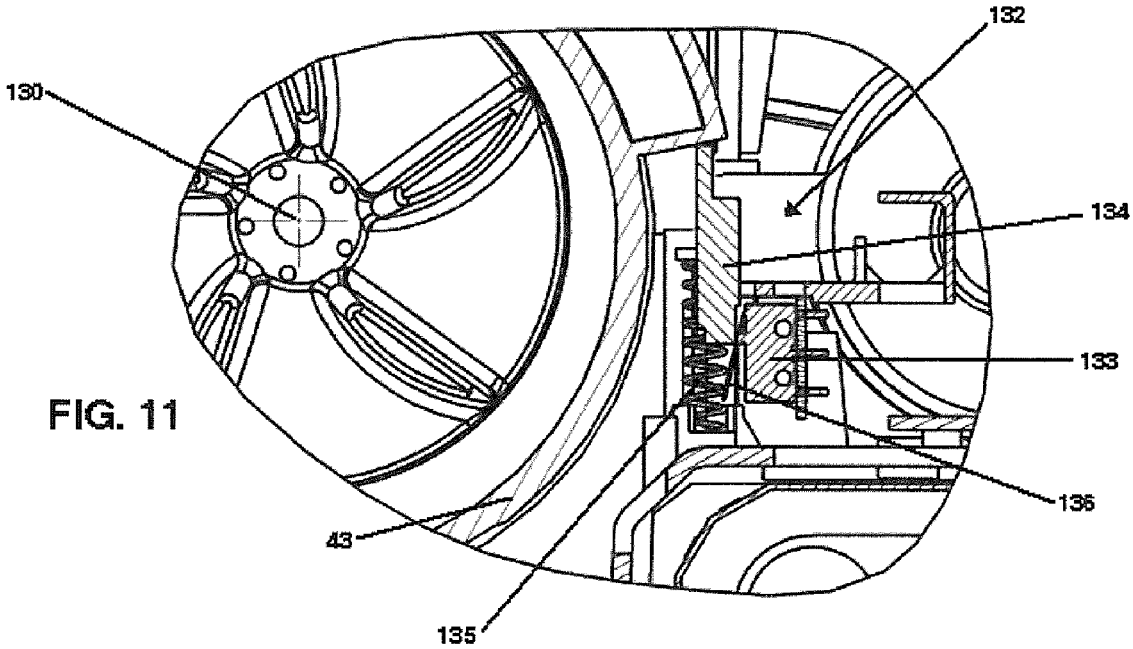
FIG. 11 is a detail of FIG. 10 showing the upper-housing in the in-use position with upper-housing position switch assembly disengaged.
Figure 12:
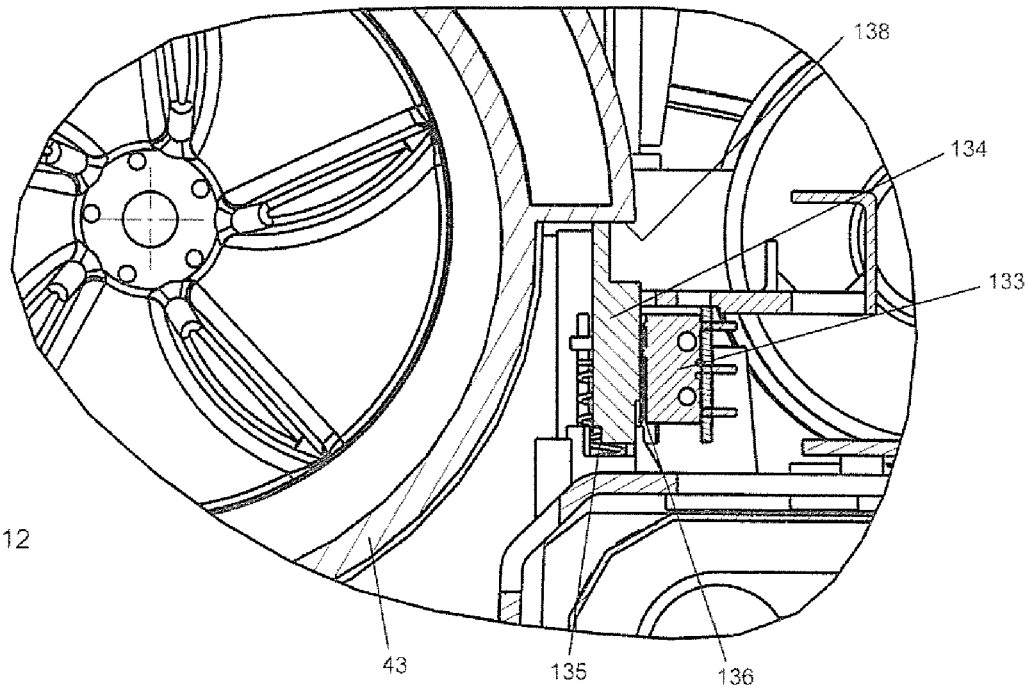
FIG. 12 is a detail of FIG. 10 showing the upper-housing in the storage position with upper-housing position switch assembly activated.

FIG. 10 is a partial cross-sectional elevation view of the device 10. FIG. 11 is a detail of FIG. 10 showing the upper-housing in the in-use position with upper-housing position switch assembly 132 disengaged. FIG. 12 is a detail of FIG. 10 showing the upper-housing in the storage position with upper-housing position switch assembly 132 activated. The upper housing 12 and lower housing 14 are connected such that the upper housing is movable in relation to the lower housing. The upper housing 12 is pivotally mounted to the lower housing and rotates about axis 130. The upper housing 12 is movable between a storage position 16, as seen in FIGS. 1 and 12, and an in-use position 18, as seen in FIGS. 10 and 11. In the storage position 16, the upper housing 12 is in a substantially upright or vertical orientation, or is rotated forward past the vertical. FIGS. 1 and 12 shows a preferred embodiment wherein the upper housing in the storage position is rotated about five degrees forward, past the vertical. In the in-use position 18, the upper housing is rotated back to an inclined position away from the vertical by at least a minimum amount. In FIGS. 10 and 11, the upper housing is rotated backward, past the vertical, by a minimum of about six degrees. The exact degrees of rotation are not critical.

The device includes an upper-housing position safety switch assembly 132. The "upper-housing position safety switch assembly" is defined as any safety switch operable to sense or detect whether the upper housing is positioned in the storage position or the in-use position; the assembly 132 prevents power from being supplied to the UV light source when the upper housing is in the storage position.

The upper-housing position safety switch assembly 132 includes a switch 133 with a lever 136 for activating the switch. The assembly 132 includes an actuator 134 biased by a spring 135. The impeller housing 43 of the upper housing 12 rotates with movement of the upper housing. When the upper housing is in the storage position, as shown in FIG. 12, a surface 138 of the impeller housing 43 contacts and depresses the actuator 134. The actuator 134, in turn, moves lever 136, thereby activating the switch 133. When the upper housing is rotated into the in-use position, the surface 138 of the impeller housing 43 moves away from the actuator 134, allowing the actuator 134 to move upwards by force of the biasing spring 135. As the actuator 134 moves upwardly, the switch 133 is disengaged as seen in FIG. 11.

The upper-housing position safety switch shown is exemplary. The upper-housing position safety switch can be a contact switch, as shown, which is activated by movement of some part of the upper housing. Alternately, the position safety switch 133 can be mounted to the upper housing and actuated as it moves in relation to some portion of the lower housing. The upper-housing position safety switch is shown as a contact switch but can alternately be a proximity, pressure or other type of switch, and can employ an optical, piezoelectric or other type of sensor. As described above, the switch assembly 132 can be a normally open or closed switch, a signal or live switch, etc. Multiple upper-housing safety switches 133 can be employed.

Figure 13:
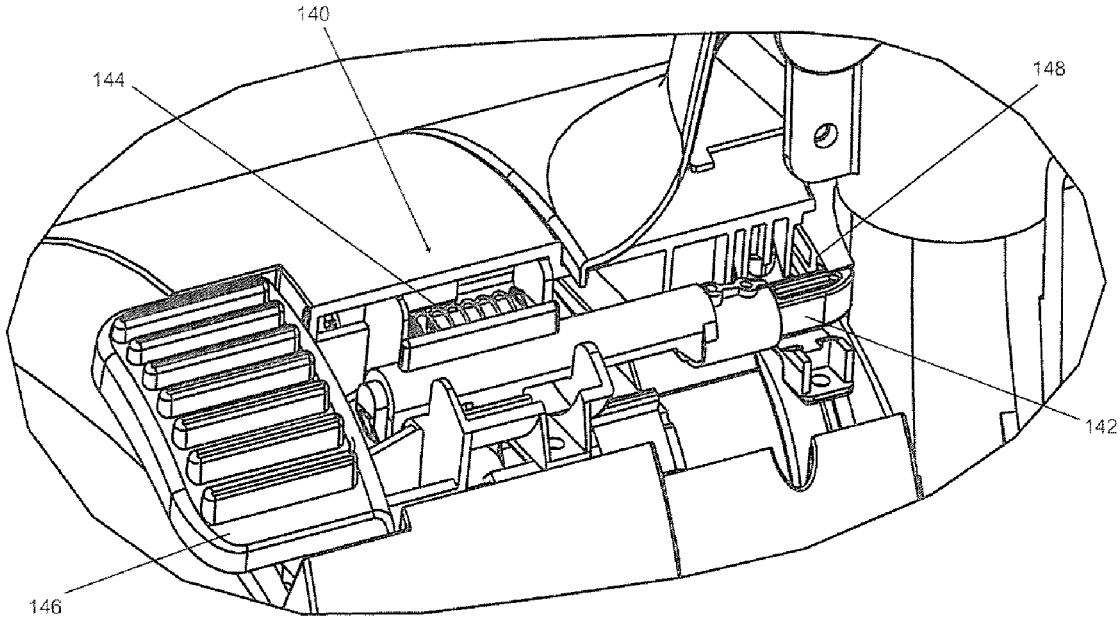
FIG. 13 a detail partial view of the storage-position locking assembly of the device.

FIG. 13 is a detail partial view of the storage-position locking assembly 140 of the device. When the upper housing 12 is in the storage position 16, it is locked in place by the locking assembly 140. Locking assembly 140 includes lock plate 142, biasing spring 144 and release pedal 146. Biasing spring 144 biases the lock plate 142 in the locked position, as shown in FIG. 13. The lock plate 142 cooperates with an indentation 148 or in the upper housing to lock the upper housing in the storage position. Depression of the release pedal 146 operates to move the lock plate 142 out of the locked position and releases the upper housing to rotate into the in-use position. Note that the upper-housing position safety switch, or another switch, can cooperate with the locking assembly to prevent power supply to the UV light when the lock plate is in the locked position.

The device 10 also incorporates a tilt safety switch assembly 150 mounted in the lower housing 14. The tilt safety switch assembly 150 includes a tilt switch 152, as seen in FIG. 5. The tilt switch is operable to prevent the supply of power to the UV light source if the tilt switch is rotated or tilted more than a preselected degree. Since the tilt switch is mounted on the lower housing, if the lower housing is tilted from a generally horizontal position the tilt switch will cut power or turn off the UV light if the lower housing is tilted. The tilt switch assembly 150 is "invisible" to the user because it is enclosed within the lower housing 14.

Figure 15:
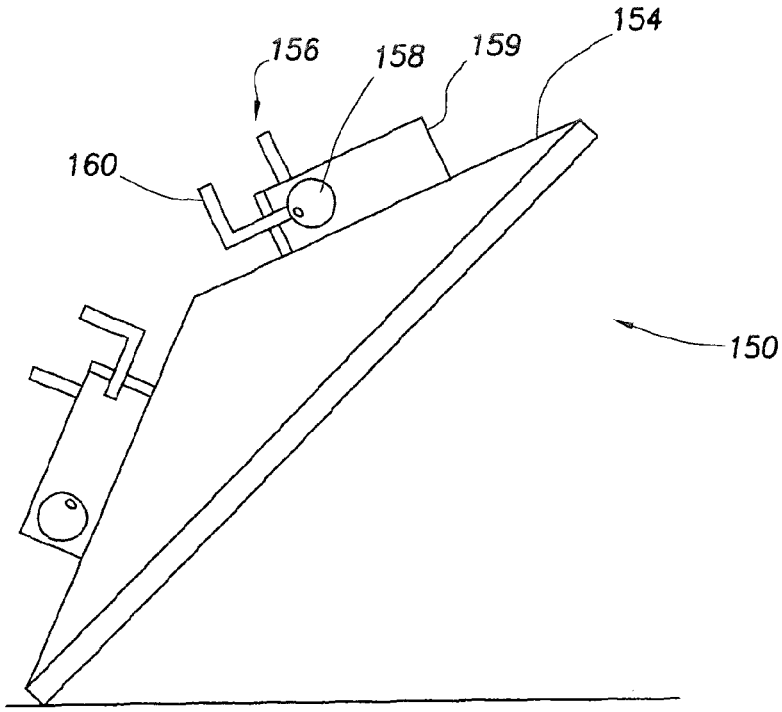
FIG. 15 is a plan elevation view of one embodiment of the tilt safety switch shown in the tilted, or activated, position.
Figure 14:
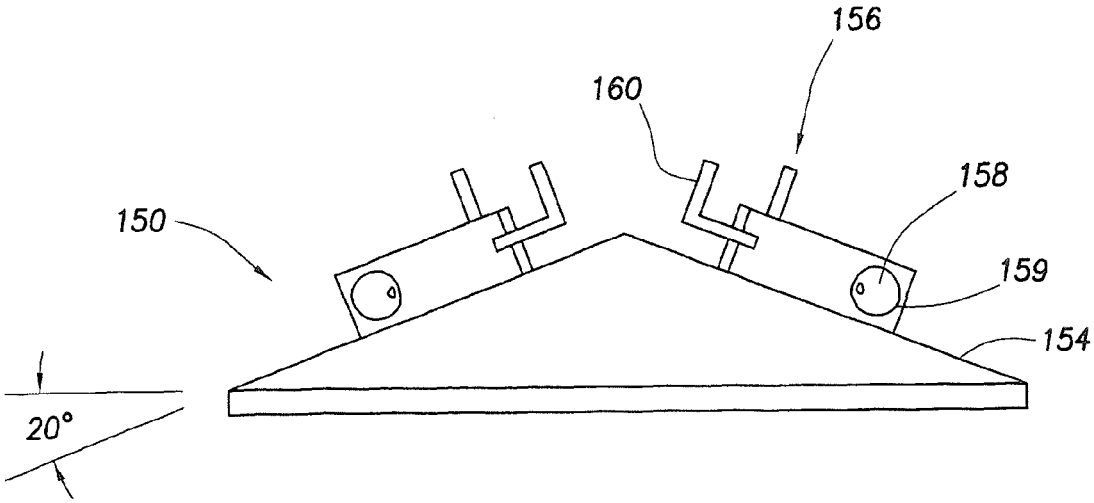
FIG. 14 is a plan elevation view of the tilt safety switch shown in the disengaged position.
Figure 16:
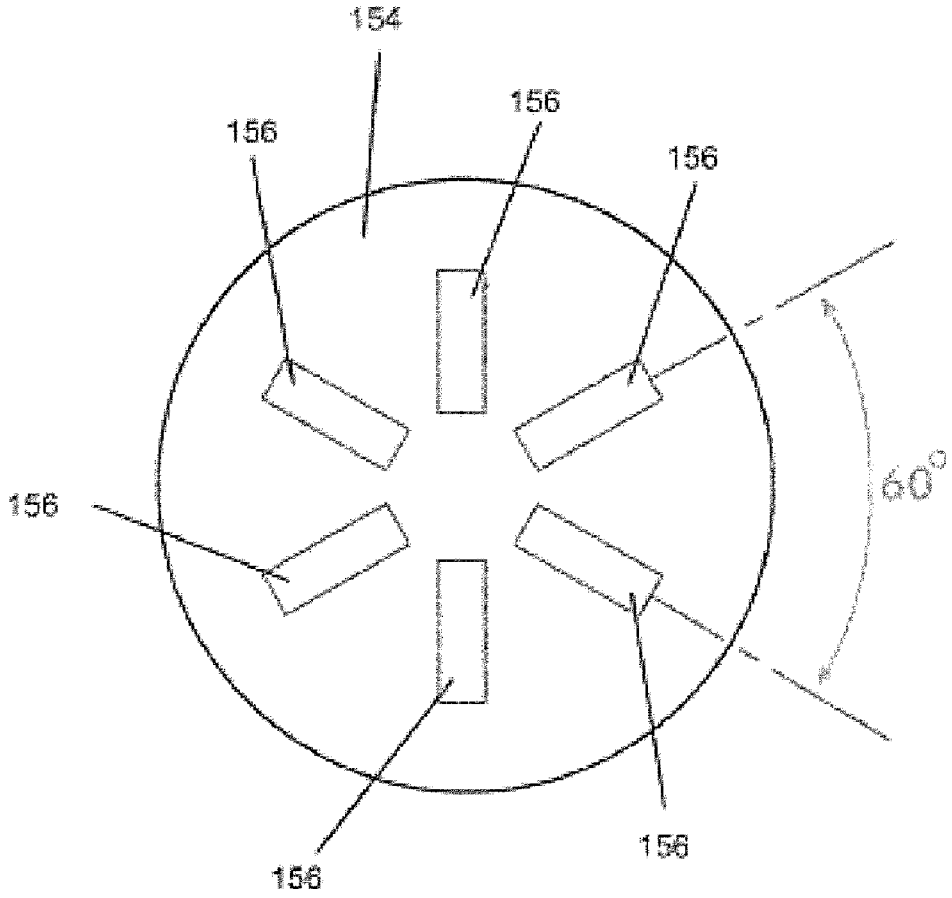
FIG. 16 is a plan top view of the embodiment of the tilt safety switch.

FIG. 14 is a plan elevation view of the tilt safety switch shown in the disengaged position. FIG. 15 is a plan elevation view of one embodiment of the tilt safety switch shown in the tilted, or activated, position. FIG. 16 is a plan top view of the tilt safety switch.

FIG. 14 show a conical surface 154 on which are mounted a plurality of ball switches 156. Each ball switch 156 has a metallic ball 158 which is free to move, or roll, inside of tube 159. At one end of tube 159 is a contact terminal 160. When the ball 158 contacts the terminal 160, the switch is activated. A ball switch is shown, however, any type of tilt switch can be employed, including mercury switches and the like. In FIG. 14 the tilt switch assembly is generally horizontal and in a disengaged position; that is, the balls are not in contact with the terminals. In FIG. 15, the assembly is shown in an activated position, where at least one of the balls is in contact with its associated terminal. When the lower housing is generally horizontal, the tilt switch is disengaged; when the lower housing is tilted a preselected degree, at least one ball will contact its terminal and activate the switch. The switch prevents the supply of power to the UV light source. Preferably the tilt switch is a signal switch that provides the microprocessor with an indication that the tilt switch is activated. The microprocessor then cuts power to the UV light source. Any reasonable degree of tilt may be selected. In the Figures, the conical surface is approximately 20 degrees from the horizontal.

FIG. 16 is a plan top view of the embodiment of the tilt safety switch. Preferably six rolling ball tilt switches are mounted on the conical surface as indicated, spaced 60 degrees apart. In such a manner, regardless of the direction of tilt from the horizontal, at least one of the switches will activate.

A microprocessor or other logic device can be electronically attached to each of the ball switches and a logic routine performed prior to preventing power supply to the UV light source. In this manner "false positives," due to motion or vibration of the lower housing, are prevented. For example, a time delay can be used, such that power is not cut to the UV light unless a ball contacts a terminal for more than a preselected amount of time, such as one-half second. Where a plurality of ball or tilt switches are in use, as in FIG. 16, the logic process can be employed so that power is cut to the UV light source only if a preselected number of switches have been activated.

FIGS. 14-16 are exemplary only. Another embodiment would employ a conical surface inverted from that shown. That is, the cone can be "upside down" with the ball switches mounted on the interior surface of the cone. Further, the conical surface can be replaced with any sloped surface regardless of its cross-sectional shape. For example, in the above example, six flat sloped surfaces can be used rather than a conical section.

Figure 17:
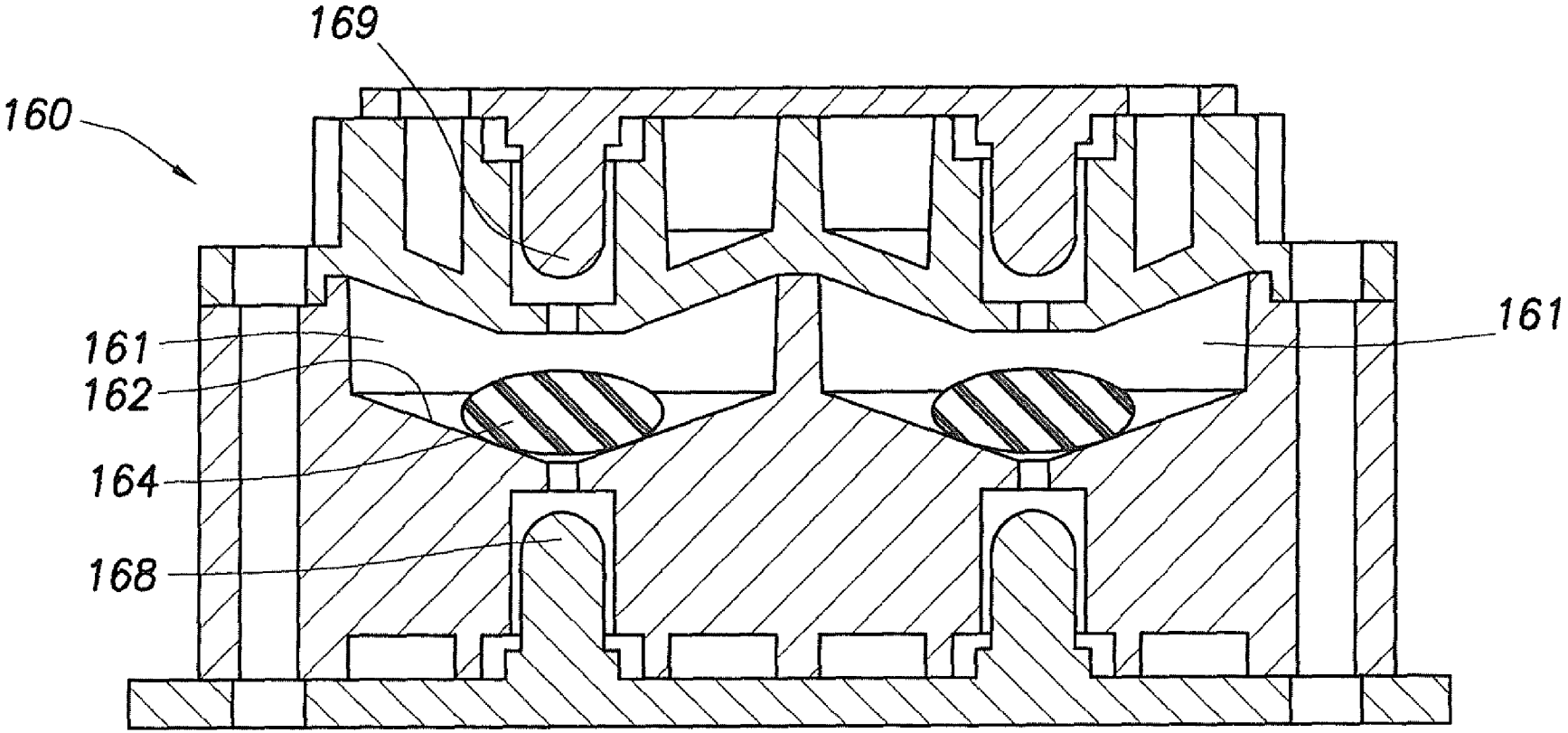
FIG. 17 is a cross-sectional elevation view of another embodiment of a tilt switch assembly for use in the device.

FIG. 17 is a cross-sectional elevation view of another embodiment of a tilt switch assembly for use in the device. The tilt safety switch assembly 150 shown in FIG. 17 also employs a conical surface 162 having an aperture 163 therein. An optical switch 167 is mounted in the assembly including an optical transmitter 168 and receiver 169. The transmitter and receiver are interchangeable. An object 164, shown as a disk-shaped ball, is placed at the apex of the conical surface and blocks transmission of the optical beam from the transmitter when the assembly is in a generally horizontal position. When the assembly is tilted or rotated a preselected degree, the object 164 moves away from the apex of the conical surface and the optical beam is unimpeded as it travels through the aperture 163 and hits receiver 169. The switch assembly, when activated by tilting, prevents power supply to the UV source, as described above. FIG. 17 is exemplary only. Those of skill in the art will recognize alternate designs with equivalent results. FIG. 17 shows two tilt switches 161 to provide redundant operation.

Figure 18:
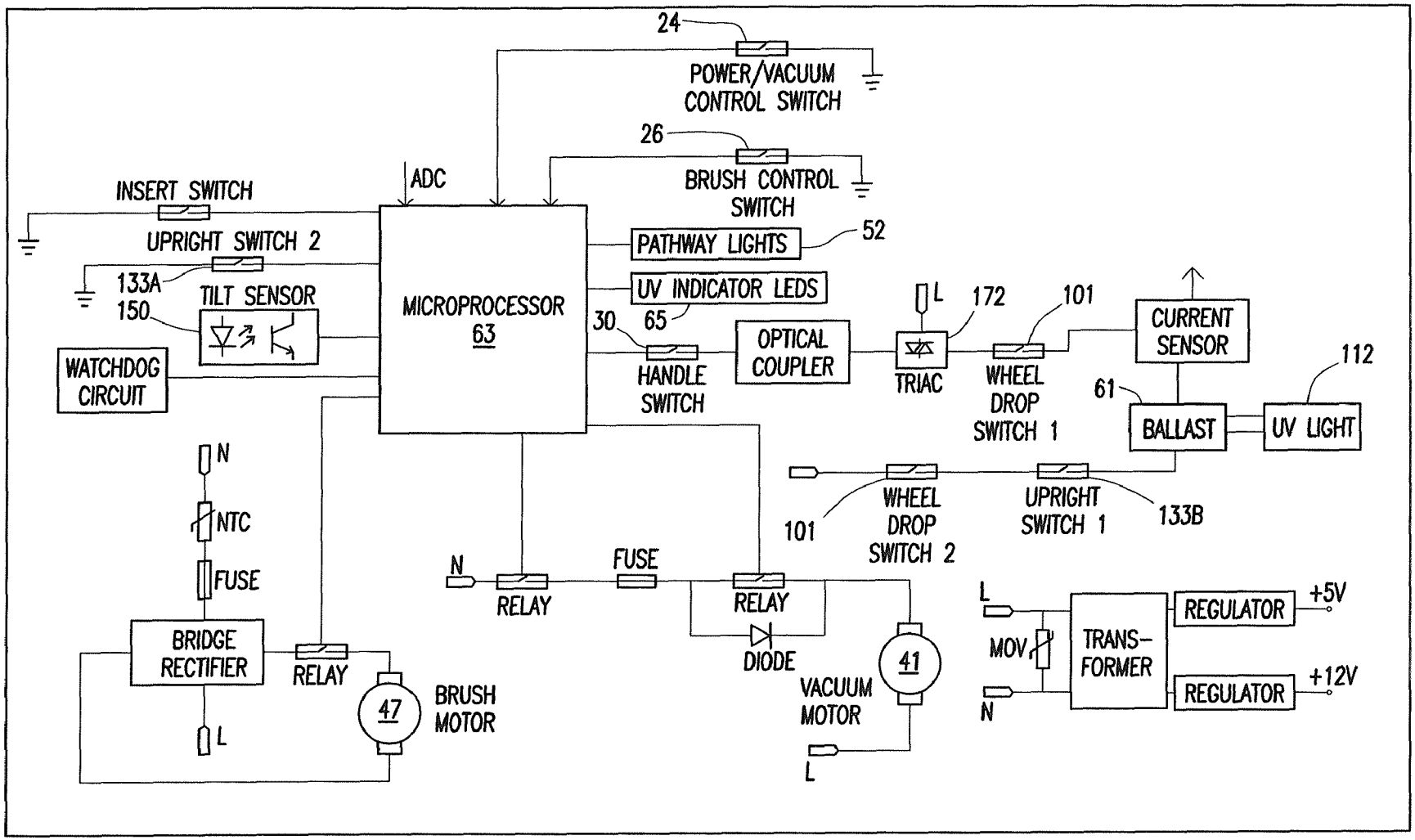
FIG. 18 is an electrical system block diagram of the device.

FIG. 18 is an electrical system block diagram of the device. The Figure is self-explanatory and shows a block diagram of the electrical circuitry 60 of the device. The microprocessor 63 is shown along with the UV light source and vacuum motor power switch 24, and brush motor power switch 26, and UV light source 112. The brush motor 47 and related circuitry are indicated. Similarly, the impeller motor 41 and related circuitry are shown. Transformer and regulators are indicated as well. The safety switch assemblies are also indicated: tilt switch assembly 150 (which can incorporate a plurality of tilt switches 152), handle safety switch 30, medium contact switches 101 (also called drop wheel switches in a favored embodiment), and two upper-housing position switches 133A and 133B. Indicator light 65 is also indicated.

The safety switches are employed to prevent power supply to the UV light source when the switches are activated by the various preset conditions indicated herein. The safety switches can also be used to prevent power supply to the vacuum motor and/or brush motor.

The microprocessor 63 is capable of performing logic functions, as a computer, and to control power supply to the various components. For example, the microprocessor can sense whether power is being supplied to the UV lights and then turn on or off the indicator light to indicate to the user whether the UV lights are on. The microprocessor can be used to perform the tilt switch logic described above. The microprocessor can be used to "read" the condition of any of the various switches, such as upper-housing position switch 133A, and then allow or prevent power supply to the UV light as desired. Some of the safety switches are arranged in series. For example, the medium contact switches 101, the upper-housing position switch 133B and the handle safety switch 30 are in series. The safety switches can be in the high voltage circuit, such as the medium contact switches (wheel drop switches) 101 and upper-housing position switch 133B, and directly cut power to the UV light 112. (Note the high voltage circuit indicated by "L" and "N.") Other safety switches can be signal switches in a low voltage circuit, such as the handle safety switch 30 which is in series with switches 101 and 133B through triac 172. Obviously, if any of the safety switches arranged in series are activated by presence of the conditions described herein (such as movement of the lower housing away from the cleaning medium, thereby allowing the wheels to drop and activating the medium contact switch), the power to the UV light is prevented.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

The examples presented herein are intended to illustrate potential and specific implementations of the present invention. It can be appreciated that the examples are intended primarily for purposes of illustration of the invention for those skilled in the art. The diagrams depicted herein are provided by way of example. There may be variations to these diagrams or the operations described herein without departing from the spirit of the invention. For instance, in certain cases, method steps or operations may be performed in differing order, or operations may be added, deleted or modified.

Furthermore, whereas particular embodiments of the invention have been described herein for the purpose of illustrating the invention and not for the purpose of limiting the same, it will be appreciated by those of ordinary skill in the art that numerous variations of the details, materials and arrangement of elements, steps, structures, and/or parts may be made within the principle and scope of the invention without departing from the invention as described in the following claims.

What is claimed is:

1. An apparatus having a vacuum cleaning device and ultraviolet (UV) light sterilizing device for use in combination to clean and sterilize a cleaning medium, the apparatus comprising:

a vacuum assembly for vacuuming a cleaning medium, the vacuum assembly having a vacuum motor for powering the vacuum;

a lower housing assembly having an UV light source, the light source positioned to direct UV light onto the cleaning medium, the UV light source emitting UV light when provided with electrical power;

electrical circuitry for controlling a supply of electrical power to the vacuum motor and UV light source, the circuitry having a microprocessor and multiple safety switches, the vacuum motor and UV light source electrically connected to the electrical circuitry;

an upper housing assembly pivotally attached to the lower housing assembly, the upper housing assembly movable between an in-use position, and a storage position wherein the upper housing assembly is maintained in a substantially upright position;

an upper-housing position safety switch connected to the UV light source through the electrical circuitry, the upper-housing position safety switch for preventing supply of electrical power to the UV light source when the upper housing is in a substantially upright position;

the upper housing having a manual on/off power switch connected to the UV light source through the electrical circuitry, the manual on/off switch for controlling supply of electrical power to the UV light source;

the upper housing having a handle, a handle safety switch attached to the handle and connected to the UV light source through the electrical circuitry, the handle safety switch operable to prevent power supply to the UV light source unless the handle safety switch is activated by constant contact by a user;

the lower housing having a tilt safety switch, the tilt safety switch connected to the circuitry and operable to prevent supply of electrical power to the UV light source if the tilt switch is tilted more than a pre-selected degree;

the lower housing having at least one cleaning medium contact switch mounted to a portion of the lower housing, each medium contact switch connected to the UV light source through the electrical circuitry, each medium contact switch operable to prevent supply of electrical power to the UV light source when the portion of the lower housing is lifted a preselected distance from the cleaning medium.

2. An apparatus as in claim 1 wherein the upper-housing position safety switch further comprises a contact switch and an actuator, the contact switch and the actuator moving into contact with each other when the upper housing is moved into the substantially upright position.

3. An apparatus as in claim 2 wherein the position safety switch further comprises a contact switch positioned on the lower housing and an actuator positioned on the upper housing, the actuator moving into contact with the contact switch when the upper housing is moved into the substantially upright position.

4. An apparatus as in claim 2 wherein the upper-housing position safety switch further comprises an optical switch.

5. An apparatus as in claim 2 wherein the upper-housing position safety switch further comprises a signal switch.

6. An apparatus as in claim 1 wherein the cleaning medium switch is actuated by direct contact with the cleaning medium.

7. An apparatus as in claim 1 wherein the cleaning medium switch is actuated by movement of at least one wheel mounted to the lower housing, the at least one wheel contacting the cleaning medium when the apparatus is in use.

8. An apparatus as in claim 6 wherein the wheel is mounted pivotally to the lower housing, and wherein vertical movement of the wheel results in activation or deactivation of the medium contact switch.

9. An apparatus as in claim 1 further comprising an indicator light, visible by the user during use of the apparatus, the indicator light connected to the electrical circuitry and turning on when the UV light source is provided with electrical power.

10. An apparatus as in claim 1 wherein the electrical circuitry further comprises a high-voltage power circuitry for supplying power to the UV light source and vacuum motor, and wherein at least three of the multiple safety switches are located in the high-voltage circuitry, the at least three safety switches arranged in series.

11. An apparatus as in claim 9 wherein the electrical circuitry further comprises a low-voltage circuitry, and wherein at least two safety switches are signal switches and connected in the low-voltage circuitry, the signal switches operable to send a signal to the microprocessor to prevent power supply to the UV light source.

12. An apparatus as in claim 1 wherein the handle safety switch further comprises a hand-operated trigger which must be depressed constantly by the user for power to be supplied to the UV light source.

13. An apparatus as in claim 1 wherein at least one of the safety switches is a normally closed switch.

14. An apparatus as in claim 1 wherein at least one of the safety switches is an optical switch.

15. An apparatus as in claim 1 wherein the tilt switch further comprises a substantially conical surface, a plurality of contact switches mounted on the surface, each of the plurality of contact switches having a metallic ball positioned in a non-metallic tube and an electrical terminal at one end of the tube.

16. An apparatus as in claim 15 wherein the conical surface is inverted.

17. An apparatus as in claim 1 wherein the tilt switch further comprises a surface having a depression therein, a movable object positioned in the depression and maintained there by gravity unless the tilt switch is tilted more than a preselected degree.

18. An apparatus as in claim 16 wherein the tilt switch further comprises an optical switch having an optical emitter and receiver, the optical emitter positioned below the tilt switch surface and emitting an optical beam through an aperture in the surface, the optical receiver positioned above the surface and above the movable object.

* * * * *